US006462675B1

(12) United States Patent
Humphrey et al.

(10) Patent No.: US 6,462,675 B1
(45) Date of Patent: Oct. 8, 2002

(54) METHOD, SYSTEM, AND PROGRAM FOR AUDITING DRIVER COMPLIANCE TO A CURRENT SPEED LIMIT

(75) Inventors: Randy Scott Humphrey, Austin; Frank Schroeder; Jonathan Mark Wagner, both of Round Rock, all of TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/689,951

(22) Filed: Oct. 13, 2000

(51) Int. Cl.[7] ..... G08G 1/09

(52) U.S. Cl. ..... 340/905; 340/441; 340/936; 701/119

(58) Field of Search ..... 340/995, 905, 340/988, 441, 936; 701/119

(56) References Cited

U.S. PATENT DOCUMENTS 3,229,249 A 1/1966 Brenner
3,686,628 A 8/1972 Keller et al.
3,763,954 A 10/1973 Permut et al.
3,775,743 A 11/1973 Carter
4,007,438 A 2/1977 Protonantis
4,229,727 A 10/1980 Gilhooley
5,485,161 A * 1/1996 Vaughn ..... 342/357
5,819,198 A 10/1998 Peretz
5,952,941 A * 9/1999 Mardirossian ..... 340/936
5,982,278 A 11/1999 Cuvelier
6,008,740 A 12/1999 Hopkins ..... 340/905
6,265,989 B1 * 7/2001 Taylor ..... 340/901

* cited by examiner

*Primary Examiner*—Brent A. Swarthout
(74) *Attorney, Agent, or Firm*—Marilyn Smith Dawkins; Bracewell & Patterson, L.L.P.

(57) ABSTRACT

In accordance with the present invention, a position of a vehicle is detected by a receiver at the vehicle from a global positioning system. A speed limit associated with the position is determined from a centralized database accessible via a wireless network. An actual speed of the vehicle at the detected position is compared with the determined speed limit for the detected position, such that if it is determined that the actual speed exceeds the determined speed limit at the detected position, the driver may be alerted.

33 Claims, 3 Drawing Sheets

METHOD, SYSTEM, AND PROGRAM FOR AUDITING DRIVER COMPLIANCE TO A CURRENT SPEED LIMIT

BACKGROUND OF THE INVENTION

1. Technical Field

The present invention relates in general to a vehicle speed detection system and, in particular, to a method, system and program for auditing driver compliance to a current speed limit range. Still more particularly, the present invention relates to a method, system and program for determining whether the vehicle's actual speed is within a current position-dependent speed limit range without the use of local speed transmitters.

2. Description of the Related Art

Speed limits and driving conditions along any given route may change frequently, particularly in urban settings. In addition, along a given route speed limits may change according to the time of day, such as during school hours or rush hours.

The current and accepted method of informing the driver of the speed limit is through posted speed limit signs on the side of the road. However, it is easy for drivers to become distracted and not notice changes in speed limit sign postings. In addition, drivers may intentionally or unintentionally exceed the posted speed limit. Exceeding a posted speed limit can have negative consequences such as personal injury, property damage, and fines from speeding tickets. Moreover, when multiple speed limit signs are posted for a single section of road (e.g. a day speed limit and a night speed limit), a driver must determine which speed is applicable.

In order to aid drivers with information about changing speed limits, several systems in addition to posted speed limit signs have been developed. For example, U.S. Pat. No. 6,008,740 ('740) describes a system for placing local transmitters near roadsides that are set to broadcast the speed limit for that range of road within a particular range and frequency. According to '740, vehicles equipped with receivers tuned to the broadcast frequency can detect speed limit broadcasts when within the broadcast range in order to provide an on-board alert to drivers exceeding the broadcast speed limit.

However, while '740 does provide an alternate system to posting speed limit signs, '740 requires placing a locally broadcasting transmitter for each speed limit designation along a roadway and in each vehicle utilizing the system. The cost of implementing such a system of multiple local transmitters is undesirable in that it would be costly to place as many local transmitters as would be needed for the system to be effective.

For example, consider an urban area with a dense network of roads, each with unique speed limits. A speed limit system would have to correctly identify current street locations and speed limits, and not be confused with an adjacent street with a potentially different speed limit. This differentiation would be difficult for a system using radio transmission. Inconsistencies in broadcast range would most likely require a tight web of low power transmitters. Purchase and maintenance costs for this type of system with a large number of units would typically be prohibitive.

Therefore, in view of the foregoing, it would be desirable to provide a method, system and program for alerting a driver of current speed limits which does not require an excessive number of transmitters and which would not present transmission difficulties in areas with multiple speed limits in a small range. In particular, it would be advantageous to provide such a centralized database of position-dependent speed limits wherein designations according to type of car, time of day, weather conditions, etc. are included.

SUMMARY OF THE INVENTION

It is therefore an object of the present invention to provide a vehicle speed detection system.

It is another object of the present invention to provide a method, system, and program for auditing driver compliance to current speed limits.

It is yet another object of the present invention to provide a method, system and program for determining whether the vehicle's actual speed is within a current position-dependent speed limit range without the use of local speed transmitters.

In accordance with the present invention, a position of a vehicle is detected by a receiver at the vehicle from a global positioning system. A speed limit associated with the position is determined from a centralized database accessible via a wireless network. An actual speed of the vehicle at the detected position is compared with the determined speed limit for the detected position, such that if it is determined that the actual speed exceeds the determined speed limit at the detected position, the driver may be alerted.

All objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

The present invention is directed to a method, system and program product implemented within a client-server system, which allows a server to maintain speed limits and road conditions according to GPS locations. In the client-server system, a client is allowed to access these speed limits and road conditions according to a current GPS location. As utilized within the invention, the term "road conditions" refers to many different types of conditions including, but not limited to, upcoming speed limit changes, time of day, upcoming construction areas, upcoming traffic flow, weather conditions, road grades, distance to emergency exit ramps, road weight limits, shoulder widths and distances, and any other information which would be useful to a driver in order to more safely operate a vehicle.

Figure 1:
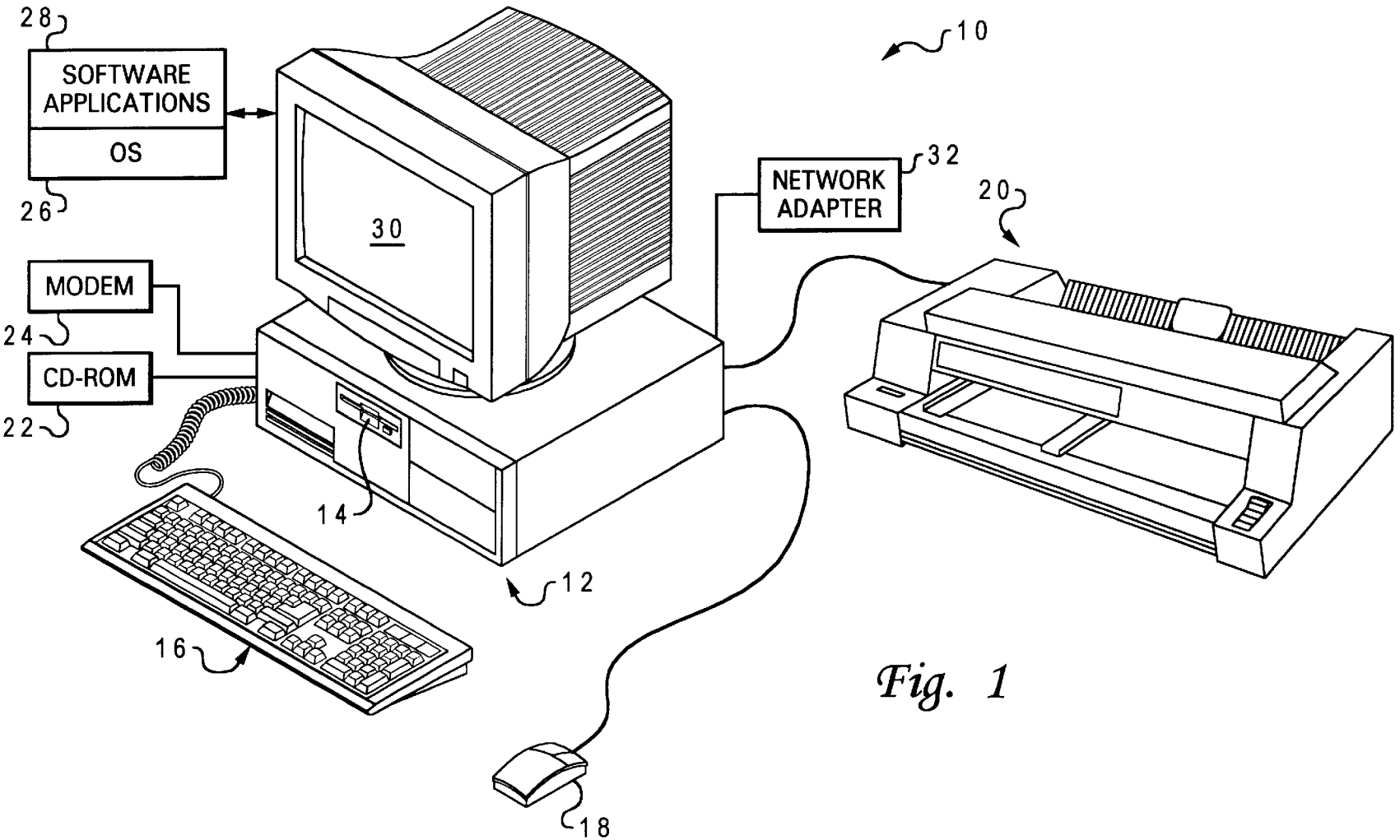
FIG. 1 depicts an illustrative embodiment of a computer system with which the method, system, and program of the present invention may advantageously be utilized.
Figure 2:
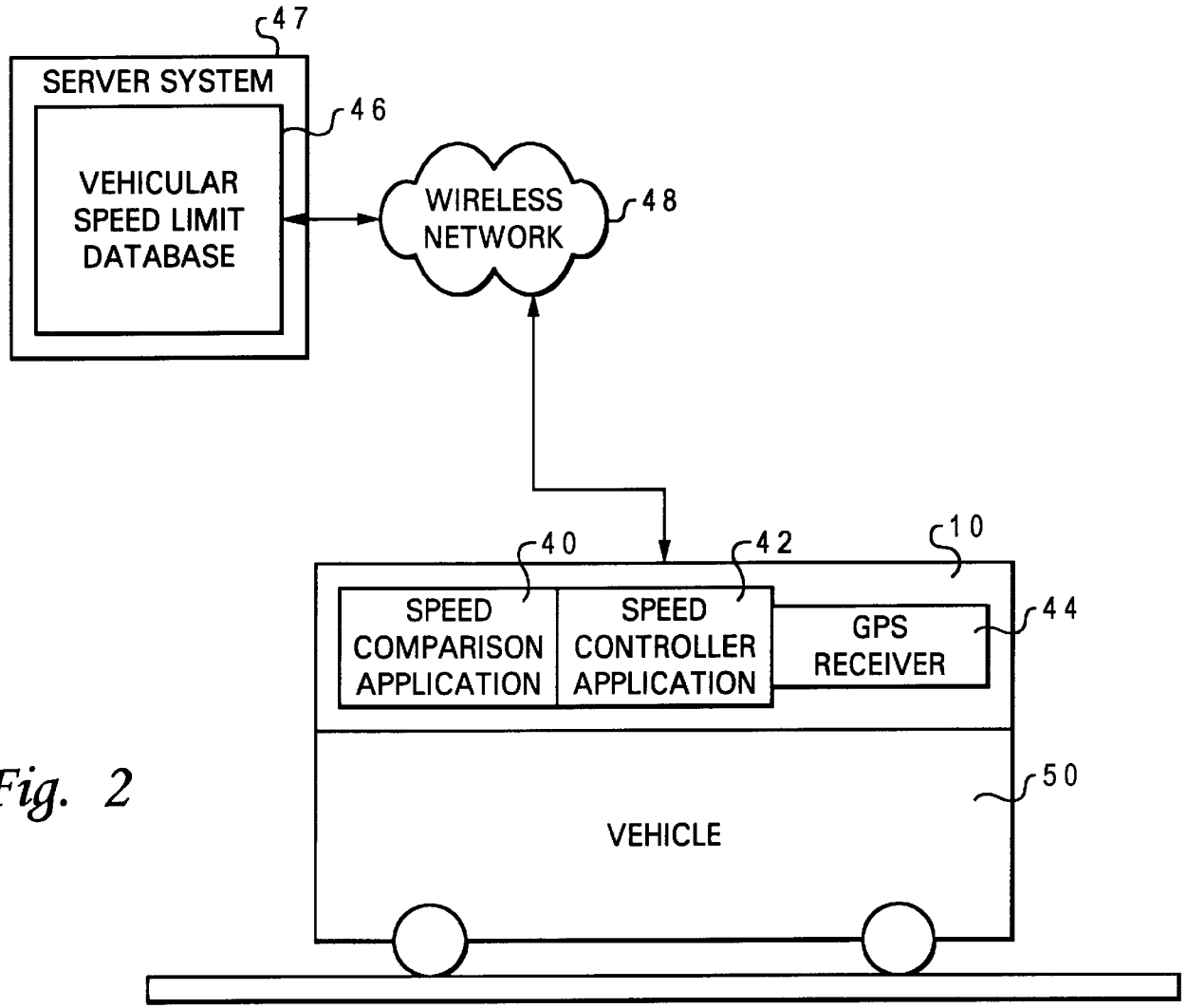
FIG. 2 illustrates a pictorial illustration of a vehicle speed auditing system in accordance with the method, system, and program of the present invention.

The invention is implemented in the data processing system and wireless network environment as illustrated in FIGS. 1 and 2, respectively. The invention may, however, be implemented in other types of data processing systems and networks, so while the present invention may be described with references to these figures, these references should not be construed in a limiting sense.

For the purposes of this invention, the term "client" is utilized to refer to both the hardware component within a vehicle which is connected to a wireless network server and the software applications stored in memory and being run on the hardware component. In the preferred embodiment, a client is provided with a connection utility for accessing the wireless Internet via several possible connection routes. The term "driver" refers primarily to an individual who operates a vehicle incorporating the client. The term "vehicle" refers primarily to any operable means of transportation including, but not limited to, cars, trucks, busses, trains, motorcycles, and bicycles.

The term "server" is also utilized to refer to both the hardware component which provides networking services and the software applications stored in memory and being run on the hardware component. The servers accessible via a wireless network are typically data processing systems having a database, operating system (OS), and server software. The server software operates within a network server and provides support for searching and transmitting speed limit and road condition data to clients. In particular, server hardware preferably includes multiple processors functioning synchronously in order to manage requests from multiple clients. In addition, a server system may include multiple servers incorporated into a network.

With reference now to the figures and in particular with reference to FIG. 1, a computer system that may be utilized as a stand-alone computer system or one of the clients or servers on a wireless network is presented. A computer system 10 comprises a Central Processing Unit (CPU) housed in a system unit 12. System unit 12 also provides connections for various hardware components including disk drives 14 and memory devices (not shown).

Several Peripheral input/output devices are connected to the CPU. These input/output devices include a keyboard 16, a mouse 18, a printer 20, a compact disk read-only memory (CD-ROM) 22, and a display monitor 30. Moreover, additional and alternate types of input/output devices may be utilized with computer system 10 as will be understood by one skilled in the art.

Also coupled to system unit 12 are various networking components, including modem 24 and network adapter 32, utilized for connecting computer system 10 to other systems and/or networks, as is illustrated in FIG. 2. Modem 24 is a communication device that enables computer system 10 to transmit information over a wireless connection. Modem 24 converts digital computer signals to interlock signals suitable for communications over this telephone media. Network adapter 32 may provide a network connection for computer system 10 to a network, such as the Internet, via multiple types of communication media such as a direct service line (DSL) connection, a wireless phone connection, a satellite connection, a cable modem connection, and other communication media which are known in the art.

Computer system 10 also preferably includes an interface, such as a graphical user interface (GUI) provided by an operating system (OS) 26 that resides within machine readable media to direct the operation of computer system 10. Any suitable machine-readable media may retain the OS, such as random access memory (RAM), ROM, and other disk and/or tape drive(e.g. magnetic diskette, magnetic tape, CD-ROM, optical disk, or other suitable storage media). Also any suitable OS 26, may direct the CPU of the computer system 10.

Further, computer system 10 preferably includes at least one software application (program product) 28 that resides within machine readable media. The software application may be accessible by OS 26, or may be incorporated into an OS control program. Preferably software application 28 contains instructions that when executed on the CPU carry out the particular operations of the present invention as described herein.

Referring now to FIG. 2, there is illustrated a pictorial illustration of a vehicle speed auditing system in accordance with the method, system, and program of the present invention. As illustrated, computer system 10 is incorporated within vehicle 50. In particular, there is a hardware interface between computer system 10 and components of vehicle 50, such as the car's speedometer and cruise control device.

Computer system 10 includes a speed comparison software application 40 and speed controller software application 42 that execute within computer system 10. Speed comparison application 40 preferably determines whether or not vehicle 50 is exceeding the current speed limit and alerts the driver of speed violations and other road conditions that may be useful to the driver. Speed controller application 42 preferably determines a signal for automatically adjusting the speed of vehicle 50 if in excess of the current speed limit.

A GPS position of vehicle 50 is preferably passively detected by GPS receiver 44. In particular, GPS receiver 44 may passively detect a position according to the GPS subscription or service utilized. For example, GPS receiver 44 may passively detect a position by detecting satellite transmissions and/or a base broadcasting location.

Speed comparison application 40 utilizes a GPS position, speed limit for the current GPS position, and actual speed of vehicle 50 to determine whether or not vehicle 50 is traveling at appropriate speeds.

The current speed limit for the current GPS position is preferably obtained for speed comparison application 40 via a connection to server 47 through a wireless network connection 48. In particular, server 47 preferably contains a vehicular speed limit database 46 that includes a table of speed limits according to GPS position ranges. For example, Table 1 may represent a portion of vehicular speed limit database 46 in accordance with the present invention.

TABLE 1

Vehicular Speed Database Example

| GPS Position Range | Speed Limit (MPH) | Vehicle Type | Time of Day | Current Road Conditions |
|---|---|---|---|---|
| Area 1 | 70 MX | Car | Day | Flow of traffic |
| | 65 MX | Truck | Day | reduced to 50 |
| | 65 MX | Car | Night | MPH starting at |
| | 60 MX | Truck | Night | Position 1 of Area 1 |
| Area 2 | 75 | Any | Now | Medium traffic, smooth flow |
| Area 3 | 65 MN L Ln | Any | Any | Wreck at |
| | 75 MX L Ln | Any | Any | Position 2 in |
| | 60 MX | Any | <32° | Area 3 |
| Area 4 | 20 MX | Any | 2 PM–4 PM | |
| | 40 MX | Any | 4 PM–2 PM | |

In the example depicted in Table 1, GPS position ranges Area 1, Area 2, Area 3 and Area 4 are included. In particular, each of these areas preferably includes a range of multiple GPS locations indicated in a standard GPS protocol including latitude, longitude, and elevation.

In the example of Area 1, maximum speed limits (MX) are provided for cars and trucks dependent upon whether it is day time or night time. In addition, a road condition warning that the flow of traffic is currently reduced to 50 MPH at GPS Position 1 is provided, such that a driver may prepare to slow down according to the speed of traffic. In particular, some roadways may include sensors that determine the average speed of the flow of traffic and report that speed to vehicular speed limit database 46.

In the example of Area 2, a posted speed limit of 75 MPH is designated for any vehicle at any time. A road condition warning about the flow of traffic is provided.

In the example of Area 3, a minimum (MN) and maximum speed limit are designated for a left lane of the highway. In addition, a conditional maximum speed limit is designated if the temperature is at freezing temperatures or below, which would negate the minimum speed. Moreover, a road condition warning of a wreck at Position 2 of Area 3 is provided such that a driver is alerted to possible slowdowns in traffic.

In the example of Area 4, maximum speed limits are designated according to time of day. For example, between 2–4 the maximum speed limit is 20 MPH while all other times the maximum is 40 MPH.

According to a preferred embodiment of the present invention, computer system 10 may transmit the current GPS position of vehicle 50 as detected by GPS receiver 44 and the vehicle type to server 47. Server 47 would then search vehicular speed limit database 46 to determine the speed limit associated with the GPS position, vehicle type, and time of day. In an alternate embodiment, computer system 10 accesses vehicular speed limit database 46, or portions thereof, and searches vehicular speed limit database 46 according to the detected GPS position of vehicle 50. In particular, it may be advantageous to transmit portions of vehicular speed limit database 46 for expected GPS position ranges to computer system 10 such that computer system 10 does not need to remain constantly connected to wireless network 48 in order to determine current speed limits.

In particular, speed comparison application 40 is preferably enabled to determine a speed and direction of travel of vehicle 50 from multiple detected GPS positions. The velocity of travel may also be determined utilizing standard speed detection instrumentation coupled to vehicle 50. By detecting a speed and direction of travel of vehicle 50 and searching vehicular speed limit database 46 utilizing the speed and direction of travel, server 47 is preferably enabled to also transmit upcoming speed limits and road conditions for GPS position areas anticipated by the direction of travel and offer alternative routes where applicable.

In addition, where there are varying speed limits and road conditions for a particular section of road-way, by determining which direction vehicle 50 is traveling, the speed limit and road condition for that particular section of roadway in the direction traveled can be determined from searching speed limit database 46. Moreover, if there are road conditions that may become more dangerous with increased or decreased speed according to the make of the car, then by searching speed limit database 46 according to the direction and speed of travel, the effects of road conditions may be specified according to the speed of vehicle 50, direction of travel, and the make of vehicle 50. For example, a car that is heavier and has snow tires may be able to travel at a faster speed uphill in snow conditions than a smaller, lighter car without the aid of specialized tires.

Speed limit database 46 preferably includes road condition details, as depicted in Table 1. Road condition details may be accumulated via multiple methods including, but not limited to, multiple types of sensors positioned at roadsides, information called in by drivers, satellite monitoring, and other such methods. For example, satellites may monitor the traffic flow of roads. Weather sensors positioned near roads may detect the light levels, fog levels, temperature levels, precipitation levels, wind levels, etc.

In response to determining that a vehicle is not within a posted speed limit range and/or receiving road condition signals, speed comparison application 40 preferably outputs indicators to a driver according to driver output preferences. A driver may designate preferences for outputs including, but not limited to, audio outputs, text outputs, visual outputs, etc. In particular, a driver's output preferences may be stored on computer system 10 according to an identifier for the driver and therefore subsequently retrieved. Identifiers for output preferences may include, but are not limited to, vocal identifiers, alphanumeric identifiers, and biometric identifiers.

Speed controller application 42 preferably provides for adjusting a speed governor for vehicle 50 according to current speed limits. In particular, a driver may include a preference for speed controller application 42 to automatically govern the speed of vehicle 50 or prompt the driver to select speed governing when excessive speeds are detected. In addition, a driver may request speed governing within a particular range of the speed limit. For example, a driver may request that on highways speed controller application 42 govern speeds to no more than five miles below the posted speed limit.

Figure 3:
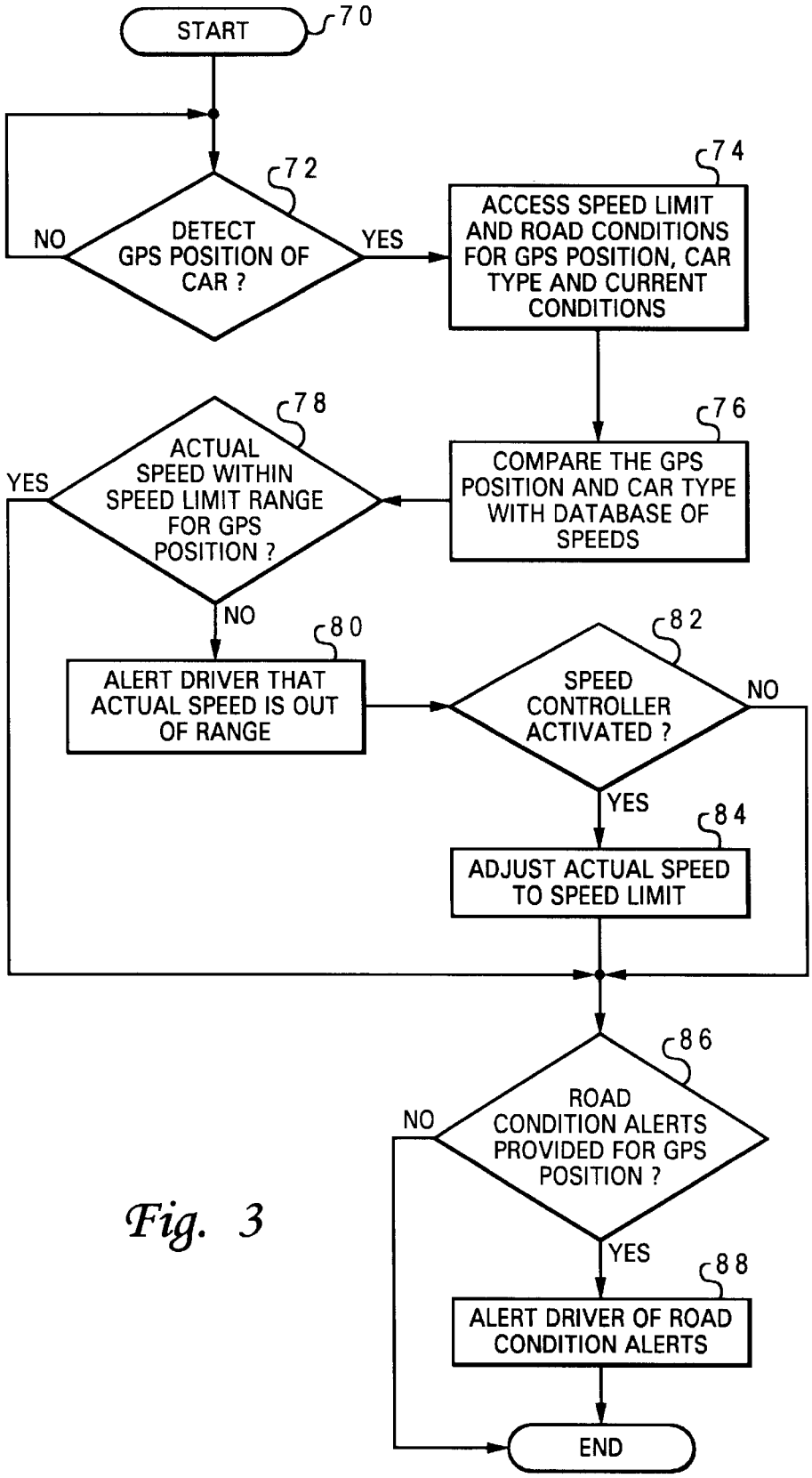
FIG. 3 depicts a high level logic flowchart of a process and program for auditing speed limits on-board a vehicle in accordance with the present invention.

With reference now to FIG. 3, there is depicted a high level logic flowchart of a process and program for auditing speed limits on-board a vehicle in accordance with the present invention. As illustrated, the process starts at block 70 and thereafter proceeds to block 72.

Block 72 depicts a determination as to whether or not the GPS position of the car is detected. If the GPS position of the car is not detected, then the process iterates at block 72. If the GPS position of the car is detected, then the process passes to block 74.

Block 74 illustrates accessing the speed limit and road conditions for the GPS position, car type, and current conditions. Next, block 76 depicts comparing the accessed speed limit with the actual vehicular speed and the process passes to block 78.

Block 78 depicts a determination as to whether or not the actual speed is within the range of speed limits designated for the GPS position. In particular, a minimum speed limit and/or maximum speed limit may be designated for a particular area of road. If the actual speed is within the range of speed limits, then the process passes to block 86. If the actual speed is not within the range of speed limits, then the process passes to block 80.

Block 80 illustrates alerting the driver that the speed is out of the designated range. In particular, the driver is preferably alerted according to driver output preferences. Next, block 82 depicts a determination as to whether or not the speed controller is activated for control. If the speed controller is not activated for control, then the process passes to block 86. If the speed controller is activated for control, then the process passes to block 84. Block 84 illustrates adjusting the actual speed to within the designated speed limits, minimum or maximum; and the process passes to block 86. In particular, a driver may designate for the speed controller to keep the actual speed within a particular range of the designated speed limits.

Block 86 depicts a determination as to whether or not road condition alerts are provided for the GPS position. If road condition alerts are not provided, then the process ends. If road condition alerts are provided, then the process passes to block 88. Block 88 illustrates alerting the driver of road condition alerts according to the driver's output preferences; and the process ends.

It is important to note that, although the present invention has been described in the context of a fully functional computer system, those skilled in the art will appreciate that the mechanisms of the present invention are capable of being distributed as a program product in a variety of forms, and that the present invention applies equally regardless of the particular type of signal-bearing media utilized to actually carry out the distribution. Examples of signal-bearing media include, but are not limited to, recordable-type media such as floppy disks or CD-ROMs and transmission-type media such as analogue or digital communications links.

While the invention has been particularly shown and described with reference to a preferred embodiment, it will be understood by those skilled in the art that various changes in form and detail may be made therein without departing from the spirit and scope of the invention.

What is claimed is:

1. A method applicable within an on-board vehicle speed monitoring system for determining whether a vehicle is traveling within a designated speed limit, said method comprising the steps of:

selecting at least one vehicle operator output preference within a vehicle speed controller application, wherein said selected vehicle operator output preference includes a speed governor setting associated with a vehicle operator;

receiving, at said vehicle speed controller application, a position of said vehicle from a global positioning system;

accessing, from a transportation database within a remote server system, a speed limit associated with said position;

comparing said accessed speed limit with said speed governor setting to determine an acceptable range of speeds for said vehicle in accordance with said position and the identity of said vehicle operator; and comparing an actual speed detected for said vehicle at said position with said determined acceptable range of speeds to determine whether said actual speed complies with said acceptable range of speeds for said vehicle operator at said position.

2. The method according to claim 1, said step of accessing, from a transportation database within a remote server system, a speed limit associated with said position, further comprising the step of:

transmitting said position to said remote server system via a wireless connection, wherein said transportation database is a centralized database.

3. The method according to claim 1, said step of accessing, from a transportation database within a remote server system, a speed limit associated with said position, further comprising the step of:

receiving at said vehicle speed controller application, from said transportation database, a plurality of road conditions associated with said position.

4. The method according to claim 1, said step of accessing, from a transportation database within a remote server system, a speed limit associated with said position, further comprising the steps of:

receiving at said vehicle speed controller application, a range of position-associated speed limits from said transportation database, wherein said range of position-associated speed limits includes said current position of said vehicle; and accessing said speed limit from among said range of position-associated speed limits according to said detected position of said vehicle.

5. The method according to claim 1, said step of accessing, from a transportation database within a remote server system, a speed limit associated with said position, further comprising the steps of:

transmitting a vehicle type identifier to said transportation database; and accessing, from said transportation database, said speed limit associated with said position and said vehicle type.

6. The method according to claim 1, said step of accessing, from a transportation database within a remote server system, a speed limit associated with said position, further comprising the step of:

accessing, from said transportation database, said speed limit associated with said position and a conditional speed limit factor.

7. The method according to claim 1, further comprising the step of:

alerting said vehicle operator by said vehicle speed controller application when said actual speed does not comply with said determined acceptable range of speeds for said vehicle in accordance with said position and the identity of said vehicle operator.

8. The method according to claim 1, further comprising the step of:

automatically adjusting, by said vehicle speed controller application, said actual speed of said vehicle to within said determined acceptable range of speeds for said vehicle operator at said position.

9. The method according to claim 1, wherein said at least one vehicle operator output preference further includes vehicle operator perceptible communication output preferences associated with said vehicle operator, said method further comprising the step of:

outputting results of said comparison of said actual speed at said position with said determined acceptable range of speeds to an output interface within said vehicle in accordance with said vehicle operator perceptible communication output preferences.

10. The method according to claim 1, further comprising the step of:

storing said at least one vehicle operator output preference in association with a vehicle operator identifier within said vehicle speed controller application.

11. The method according to claim 10, wherein said vehicle operator identifier is a biometric identifier, said method further comprising, selecting said at least one vehicle operator output preference in accordance with at least one biometric parameter input by said vehicle operator.

12. A system for use with an on-board vehicle speed monitoring system for determining whether a vehicle is traveling within a designated speed limit, said system comprising:

means for selecting at least one vehicle operator output preference within a vehicle speed controller application, wherein said selected vehicle operator output preference includes a speed governor setting associated with a vehicle operator;

means for receiving, at said vehicle speed controller application, a position of said vehicle from a global positioning system;

means for accessing, from a transportation database within a remote server system, a speed limit associated with said position;

means for comparing said accessed speed limit with said speed governor setting to determine an acceptable range of speeds for said vehicle in accordance with said position and the identity of said vehicle operator; and means for comparing an actual speed detected for said vehicle at said position with said determined acceptable range of speeds to determine whether said actual speed complies with said acceptable range of speeds for said vehicle operator at said position.

13. The system according to claim 12, said means for accessing, from a transportation database within a remote server system, a speed limit associated with said position, further comprising:

means for transmitting said position to said remote server system via a wireless connection, wherein said transportation database is a centralized database.

14. The system according to claim 12, said means for accessing, from a transportation database within a remote server system, a speed limit associated with said position, further comprising:

means for receiving at said vehicle speed controller application, from said transportation database, a plurality of road conditions associated with said position.

15. The system according to claim 12, said means for accessing, from a transportation database within a remote server system, a speed limit associated with said position, further comprising:

means for receiving at said vehicle speed controller application, a range of position-associated speed limits from said transportation database, wherein said range of position-associated speed limits includes said current position of said vehicle; and means for accessing said speed limit from among said range of position-associated speed limits according to said detected position of said vehicle.

16. The system according to claim 12, said means for accessing, from a transportation database within a remote server system, a speed limit associated with said position, further comprising:

means for transmitting a vehicle type identifier to said transportation database; and means for accessing, from said transportation database, said speed limit associated with said position and said vehicle type.

17. The system according to claim 12, said means for accessing, from a transportation database within a remote server system, a speed limit associated with said position, further comprising:

means for accessing, from said transportation database, said speed limit associated with said position and a conditional speed limit factor.

18. The system according to claim 12, further comprising:

means for alerting said vehicle operator by said vehicle speed controller application when said actual speed does not comply with said determined acceptable range of speeds for said vehicle in accordance with said position and the identity of said vehicle operator.

19. The system according to claim 12, further comprising:

means for automatically adjusting, by said vehicle speed controller application, said actual speed of said vehicle to within said determined acceptable range of speeds for said vehicle operator at said position.

20. The system according to claim 12, wherein said at least one vehicle operator output preference further includes vehicle operator perceptible communication output preferences associated with said vehicle operator, said system further comprising:

means for outputting results of said comparison of said actual speed at said position with said determined acceptable range of speeds to an output interface within said vehicle in accordance with said vehicle operator perceptible communication output preferences.

21. The system according to claim 12, further comprising:

means for storing said at least one vehicle operator output preference in association with a vehicle operator identifier within said vehicle speed controller application.

22. The system according to claim 21, wherein said vehicle operator identifier is a biometric identifier, said system further comprising, means for selecting said at least one vehicle operator output preference in accordance with at least one biometric parameter input by said vehicle operator.

23. A program applicable within an on-board vehicle speed monitoring system for determining whether a vehicle is traveling within a designated speed limit, residing on a computer usable medium having computer readable program code means, said program comprising:

program instruction means for selecting at least one vehicle operator output preference within a vehicle speed controller application, wherein said selected vehicle operator output preference includes a speed governor setting associated with a vehicle operator;

program instruction means for receiving a position of said vehicle from a global positioning system;

program instruction means for accessing, from a transportation database within a remote server system, a speed limit associated with said position;

program instruction means for comparing said accessed speed limit with said speed governor setting to determine an acceptable range of speeds for said vehicle in accordance with said position and the identity of said vehicle operator; and program instruction means for comparing an actual speed at said position with said determined acceptable range of speeds to determine whether said actual speed complies with said acceptable range of speeds for said vehicle operator at said position.

24. The program according to claim 23, further comprising:

program instruction means for delivering said position to said database via a wireless connection, wherein said database is a centralized database.

25. The program according to claim 23, further comprising:

program instruction means for receiving, from said transportation database, a plurality of road conditions associated with said position.

26. The program according to claim 23, further comprising:

program instruction means for receiving a range of position-associated speed limits from said transportation database, wherein said range of position-associated speed limits includes said current position of said vehicle; and program instruction means for accessing said speed limit from said range of positions associated speed limits according to said detected position of said vehicle.

27. The program according to claim 23, further comprising:

program instruction means for delivering a vehicle type identifier to said transportation database; and program instruction means for accessing said speed limit associated with said position and said vehicle type.

28. The program according to claim 23, further comprising:

program instruction means for accessing said speed limit associated with said position and a conditional speed limit factor.

29. The program according to claim 23, further comprising:

program instruction means for alerting said vehicle operator when said actual speed does not comply with said determined acceptable range of speeds for said vehicle in accordance with said position and the identity of said vehicle operator.

30. The program according to claim 23, further comprising:

program instruction means for automatically adjusting said actual speed of said vehicle to within said determined acceptable range of speeds for said vehicle operator at said position.

31. The program according to claim 23, wherein said at least one vehicle operator output preference further includes vehicle operator perceptible communication output preferences associated with said vehicle operator, further comprising:

program instruction means for outputting results of said comparison of said actual speed at said position with said determined acceptable range of speeds to an output interface within said vehicle in accordance with said vehicle operator perceptible communication output preferences.

32. The program according to claim 23, further comprising:

program instruction means for storing said at least one vehicle operator output preference in association with a vehicle operator identifier within said vehicle speed controller application.

33. The program according to claim 32, wherein said vehicle operator identifier is a biometric identifier, said program further comprising, program instruction means for selecting said at least one vehicle operator output preference in accordance with at least one biometric parameter input by said vehicle operator.

* * * * *